US007878337B2

(12) United States Patent
Abdullah

(10) Patent No.: US 7,878,337 B2
(45) Date of Patent: Feb. 1, 2011

(54) MULTI-CHAMBER CONTAINER

(76) Inventor: Adel M. A. Abdullah, P.O. Box 3200, Safat 13032 (KW)

( * ) Notice: Subject to any disclaimer, the term of this patent is extended or adjusted under 35 U.S.C. 154(b) by 140 days.

(21) Appl. No.: 11/949,915

(22) Filed: Dec. 4, 2007

(65) Prior Publication Data

US 2009/0139880 A1 Jun. 4, 2009

(51) Int. Cl.
*A47B 81/00* (2006.01)
*A47B 49/00* (2006.01)

(52) U.S. Cl. ..... 211/10; 312/285; 220/522

(58) Field of Classification Search ..... 211/10, 211/70, 71.01, 77, 78, 115, 126.1, 128.1, 211/131.1, 144, 163, 194; 206/1.7, 214, 206/575; 220/23.2, 23.8, 506, 521, 522, 220/523, 553; 248/349.1; 312/283, 285, 312/321.5, 328, 329

See application file for complete search history.

(56) References Cited

U.S. PATENT DOCUMENTS

| | | | | | |
|---|---|---|---|---|---|
| 226,645 | A | * | 4/1880 | Albaugh | 211/129.1 |
| 853,215 | A | * | 5/1907 | Berg | 211/126.1 |
| 931,960 | A | * | 8/1909 | Robinson | 211/129.1 |
| 1,887,648 | A | * | 11/1932 | Krueger | 211/10 |
| D172,113 | S | * | 5/1954 | Smith | D28/76 |
| D175,790 | S | * | 10/1955 | McCann | D6/488 |
| 2,749,198 | A | * | 6/1956 | Berber | 312/249.1 |
| 3,317,097 | A | * | 5/1967 | Giordano | 224/182 |
| 3,378,134 | A | * | 4/1968 | Wilkinson et al. | 312/97.1 |
| D233,278 | S | * | 10/1974 | Wilbourn | D21/397 |
| D256,856 | S | * | 9/1980 | Kleinman | D6/423 |
| 4,305,511 | A | * | 12/1981 | Denholtz | 211/70 |
| D266,435 | S | * | 10/1982 | Laughlin | D19/75 |
| D279,385 | S | * | 6/1985 | Lieberman | D19/77 |
| D279,950 | S | * | 8/1985 | Wan | D7/640 |
| 4,534,474 | A | * | 8/1985 | Ng | 211/70 |
| 4,613,041 | A | * | 9/1986 | Carlton | 206/373 |
| 4,732,274 | A | * | 3/1988 | Bouton | 206/561 |
| D296,568 | S | * | 7/1988 | Nadeau | D19/77 |
| 4,756,412 | A | * | 7/1988 | Graves et al. | 206/315.11 |
| 4,823,958 | A | * | 4/1989 | Mahmud | 206/561 |
| 5,009,336 | A | * | 4/1991 | Liaw | 211/69.1 |
| D321,788 | S | * | 11/1991 | Chen | D3/295 |
| D329,766 | S | * | 9/1992 | Ancona et al. | D6/467 |
| D329,876 | S | * | 9/1992 | Breen | D19/75 |
| 5,305,544 | A | * | 4/1994 | Testa, Jr. | 43/54.1 |
| D356,829 | S | * | 3/1995 | Russomano et al. | D19/77 |
| D372,938 | S | * | 8/1996 | Wilson et al. | D19/75 |
| D377,807 | S | * | 2/1997 | Green et al. | D19/77 |
| 5,782,359 | A | * | 7/1998 | McAllister et al. | 206/538 |
| D407,753 | S | * | 4/1999 | Kwok | D19/77 |
| D418,947 | S | * | 1/2000 | Greiner | D28/73 |
| 6,026,960 | A | * | 2/2000 | Cogliano | 206/575 |

(Continued)

*Primary Examiner*—Michael Safavi
*Assistant Examiner*—Joshua Rodden
(74) *Attorney, Agent, or Firm*—Lowe Hauptman Ham & Berner, LLP

(57) ABSTRACT

A rotatable two tier multi-chamber container includes a support member and an octagonal shaped base rotatably mounted on the support member. The base member includes an outer wall, an inner wall and a plurality of radially extending divider walls extending between the inner and outer walls to form a plurality of trapezoidal shaped adjacent lower chambers surrounding an inner chamber. The container also includes a plurality of trapezoidal shaped upper chambers opening outwardly away from the inner chamber and a plurality of trapezoidal shaped covers for covering the upper and lower chambers.

12 Claims, 3 Drawing Sheets

U.S. PATENT DOCUMENTS

| | | | | | |
|---|---|---|---|---|---|
| D428,624 | S | * | 7/2000 | Kwok | D19/77 |
| D432,577 | S | * | 10/2000 | Yeh | D19/77 |
| 6,131,745 | A | * | 10/2000 | Baker, Jr. | 211/13.1 |
| 6,446,828 | B1 | * | 9/2002 | Casteel | 220/575 |
| 6,591,990 | B2 | * | 7/2003 | Lanman et al. | 211/10 |
| 6,942,109 | B2 | * | 9/2005 | Aros et al. | 211/58 |
| D552,881 | S | * | 10/2007 | Rittmann | D6/469 |
| 7,380,686 | B1 | * | 6/2008 | Friedman et al. | 220/826 |
| D575,986 | S | * | 9/2008 | Cetera | D7/501 |
| 2009/0013566 | A1 | * | 1/2009 | Cetera | 40/124.06 |

* cited by examiner

MULTI-CHAMBER CONTAINER

FIELD OF INVENTION

This invention relates to a multi-chamber container and more particularly to a polygonal shaped multi-chamber container with upper and lower chambers for stationery supplies.

BACKGROUND FOR THE INVENTION

Multi-chamber containers are well known and have been frequently used for pills, candy, screws, bolts and other hardware supplies, tools and at least in one instance as a rack for stationery supplies. For example, an early patent of Karoff, U.S. Pat. No. 2,613,518 discloses a multi-compartment dish with contacting covers and a cover actuating rod. The dish can be used for serving candy, relishes or similar articles and also for containing jewelry or other small articles. The dish is in the form of a receptacle having a plurality of individual compartments which in turn are equipped with operable covers. As disclosed, the dish is equipped with a central handle together with means on the handle for simultaneously opening and closing the covers.

A capsule or pill dispenser is disclosed in a U.S. Pat. No. 3,926,335 that includes upper and lower pill storage tiers each having twelve radial pill storage compartments. As shown each tier is covered by a rotatable dial cover having a generally horizontal opening for a pill insertion and a vertical opening for pill discharges. A somewhat similar pill container is disclosed in U.S. Pat. No. 5,782,359 of McAllister et al. As described, the container includes a plurality of compartments and a lid such that when the lid is in the closed position, compartments cannot be opened. As disclosed, the container includes a plurality of trapezoidal shaped compartments disposed around a circular opening to form a polygonal shaped contour. The trapezoidal shaped covers each have an trapezoidal shaped lid that opens outwardly.

Further a detachable stationary case rack is disclosed in U.S. Patent of Huang et al., U.S. Pat. No. 4,953,696. As shown, the case rack has a polygonal bottom case divided into several compartments forming a hollow central shaft. The base of the rack has a packing set therein which packing includes several round balls to permit rotation of the whole assembly against the base. Through series connections, the number of stationery receiving cases maybe flexibly arranged according to requirements.

Notwithstanding the above it is presently believed that there may be a commercial market for an improved multi-chamber container with upper and lower chambers for pencils, pens and other stationery supplies. It is believed that there is a potential market because such multi-chamber containers have sufficient chambers to store stationery supplies in various sizes. For example, there are containers for large and small paper clips, for different sizes of post-its and compartments for ten to sixteen items. Further, such containers can be manufactured and sold at a competitive price, are portable, easy to use, rotatable, etc.

BRIEF SUMMARY OF THE INVENTION

In essence, the invention contemplates a multi-chamber container for statutory supplies comprising a polygon shaped base member having a cross-sectional shape of a pentagon, hexagon, heptagon or octagon and wherein each of the outer sides are essentially equal. The polygon shaped base member is rotatably mounted on a support member for positioning a container on a flat surface such as a desk, table, countertop etc. The base member includes an outer wall, an inner wall and plurality of radially extending divider or side walls extending between the inner wall and the outer wall to form a plurality of trapezoidal shaped adjacent lower chambers surrounding the inner chamber.

The multi-chamber container also includes a plurality of adjacent trapezoidal shaped upper chambers surrounding the inner chamber and having essentially the same shape of the adjacent trapezoidal shaped lower chamber. The upper chambers each includes a solid bottom, an upper inner wall, an upper outer wall and two radially extending upper walls connecting the upper inner wall and the upper outer wall.

The outer walls of each of the trapezoidal shaped upper chambers are hingedly connected to the outer wall of a corresponding trapezoidal shaped lower chamber. Therefore the outer walls of each of the trapezoidal shaped upper chamber are hingely connected to the outer wall of a corresponding trapezoid shaped lower chamber. In this way, the trapezoidal shaped upper chamber can be folded over to a superposed inverted position on top of a corresponding trapezoidal shaped lower chamber or open outwardly to provide a flower (with open pedals) like arrangement.

The multi-chamber container also includes a plurality of trapezoidal shaped closure panels or lids having a size and shape corresponding to the size and shape of a lower chamber. One of the lids forms a closure for a trapezoidal shaped upper chamber and a trapezoidal shaped lower chamber. Each of the trapezoidal shaped lids is hingely connected.

The invention will now be described in connection with the accompanying drawings wherein like reference numerals have been used to indicate like parts.

DESCRIPTION OF THE PREFERRED EMBODIMENTS OF THE INVENTION

A dual tier multi-chamber container 20 in accordance with a preferred embodiment of the invention will not be described in connection with FIGS. 1-4.

As illustrated, the dual tier multi-chamber container 20 is designed for pencils, pens and other stationery supplies, but can be used for many other purposes whatever is so desired to maintain a plurality of different small items such as screws and nuts and readily accessible separate chambers.

Figure 1:
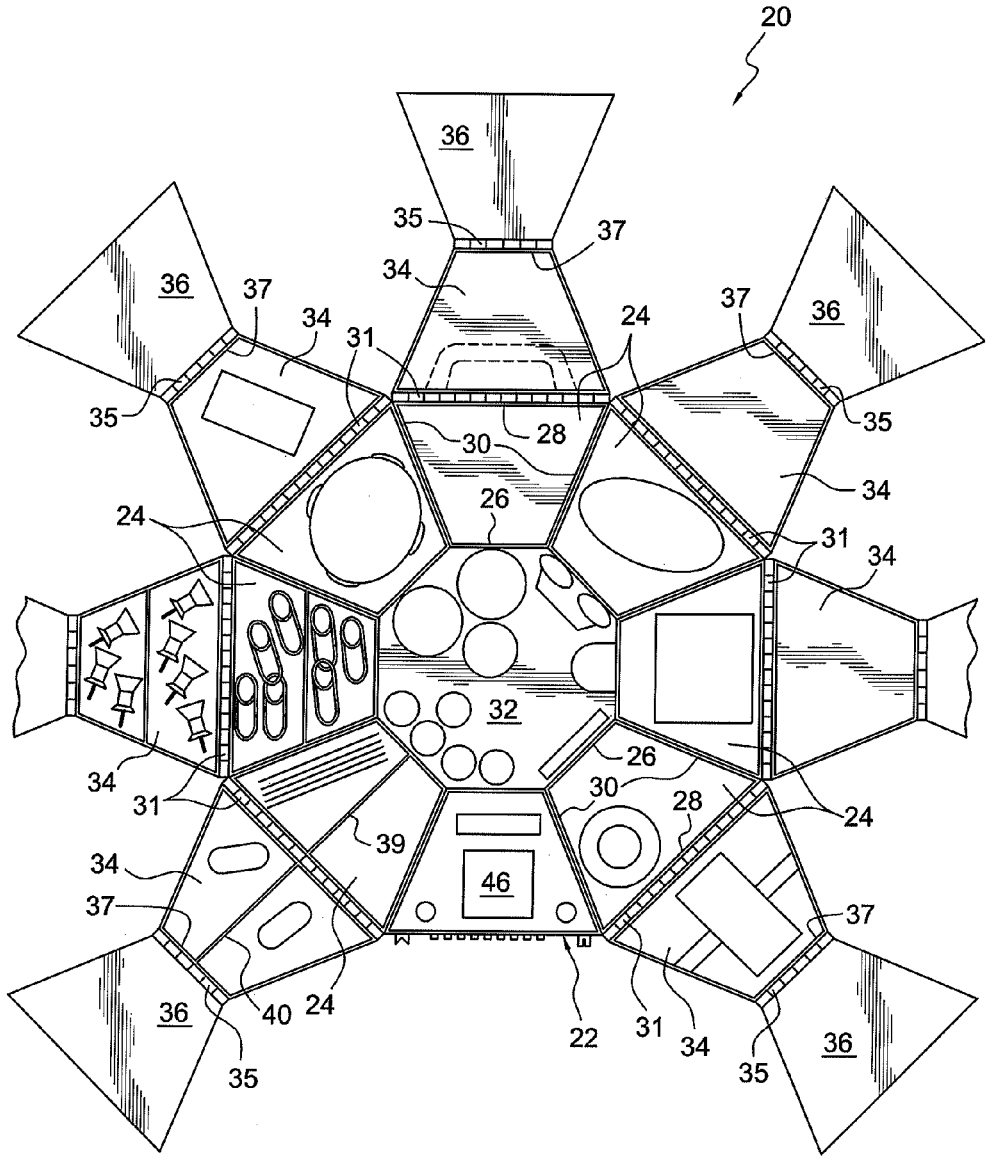
FIG. 1 is a top or plan view of a multi-chamber container in accordance with a preferred embodiment of the invention.

The container 20 includes an octagon shaped base member 22 that is divided into a plurality of trapezoidal shaped lower chambers 24. As shown, there are eight lower chambers defined by an inner wall 26, and outer wall 28 and a plurality of dividers or side walls 30. As shown in FIG. 1, the preferred embodiment of the invention has a shape of an octagon and octagonal inner chamber 32 defined by the inner wall or walls 26.

The dual tier multi-chamber container 20 also includes a second or upper tier that includes a plurality of trapezoidal shaped upper chambers 34. As shown, multi-chamber container 20 includes seven trapezoidal upper chambers 34 which are the same size and shape as the trapezoidal shaped lower chambers 24.

The upper chambers 34 are attached to the lower chamber 24 by hinges 31 along the longer of the parallel sides of the trapezoidal shaped chamber and are adapted to open or unfold outwardly away from the center chamber 32. As shown in FIG. 1, the multi-chamber container 20 includes eight lower chambers but only seven upper chambers. In should be recognized that it is also contemplated to have the same number of upper chambers as lower chambers. However, in one preferred embodiment of the invention, one of the lower chambers 24 is used to house a radio or the like and in such cases a corresponding upper chamber has been eliminated.

An important aspect of the present invention resides in the use of a plurality of trapezoidal shaped dual function covers or lids 36. The lids 36 have the same shape i.e. the same length and width dimensions as the lower and upper chambers 24 and 34 respectfully. The lids 36 are connected to the outer sides 37 of the upper chambers 34 by hinges 35 along the shorter of the parallel sides of the trapezoidal shaped upper chambers 34. Therefore, the lids 36 are foldable inwardly over the upper chamber 34 and serves as a closure or closures for the upper chambers 34. Then when the covered upper chambers 34 are folded over onto the lower chambers 24, the lids 36 together with the upper chamber 34 act as covers for the lower chambers 24. It should also be recognized that each of the chambers 24 and 34 may be divided by an inner wall 39 or 40 to form smaller chambers. The use of inner walls 39 and 40 may be used to separate different sizes of paper clips or the like.

Figure 2:
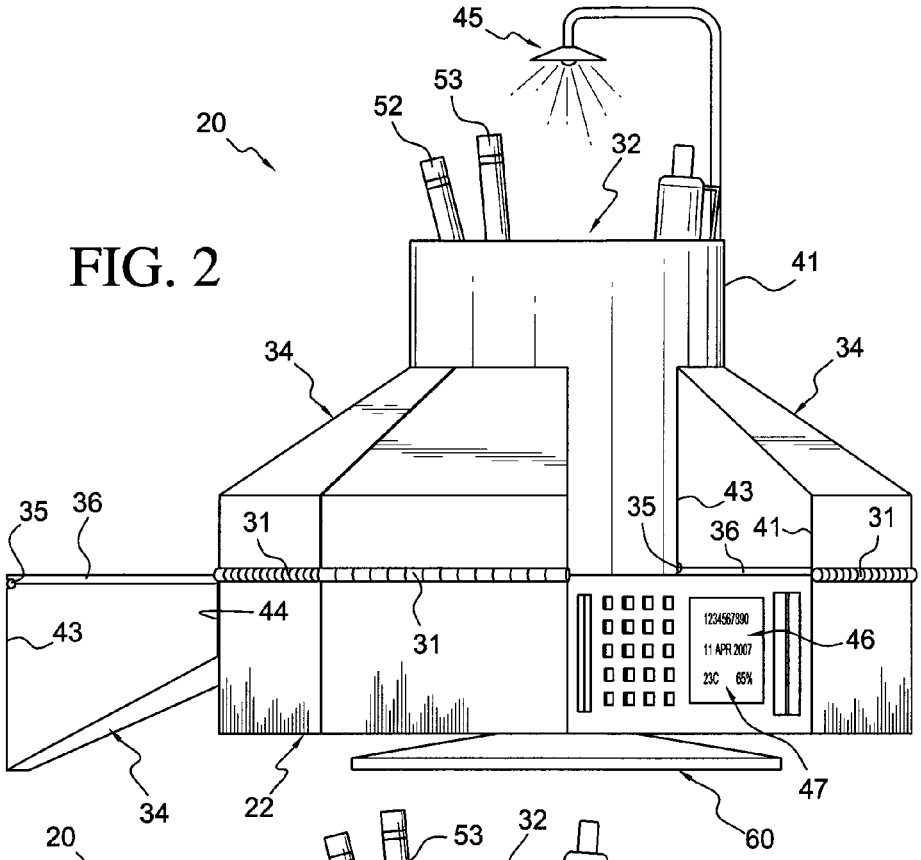
FIG. 2 is front elevational view of a multi-chamber container in accordance with a second embodiment of the invention wherein one compartment is in an open position and an upper compartment in a partially closed position.

The center chamber 32 may include an upwardly extending inner wall 41 as shown in FIG. 2. As shown in FIG. 2, the upper chamber 34 has sides in the shape of an unequal trapezoid i.e. where one side 44 is shorter than side 43 which provides buttress like support or appearance for the inner wall 41 and upper chamber 34 with a different depth from the inner side to the outer side thereof. The embodiment of the invention as shown in FIG. 2 also includes a small lamp or light 45 to illuminate the contents of the multi-chamber container 20 which is preferably made of a transparent plastic and extends upwardly above the open chamber 32. Also shown is a radio 46 and temperature/humidity indicator 47.

Figure 3:
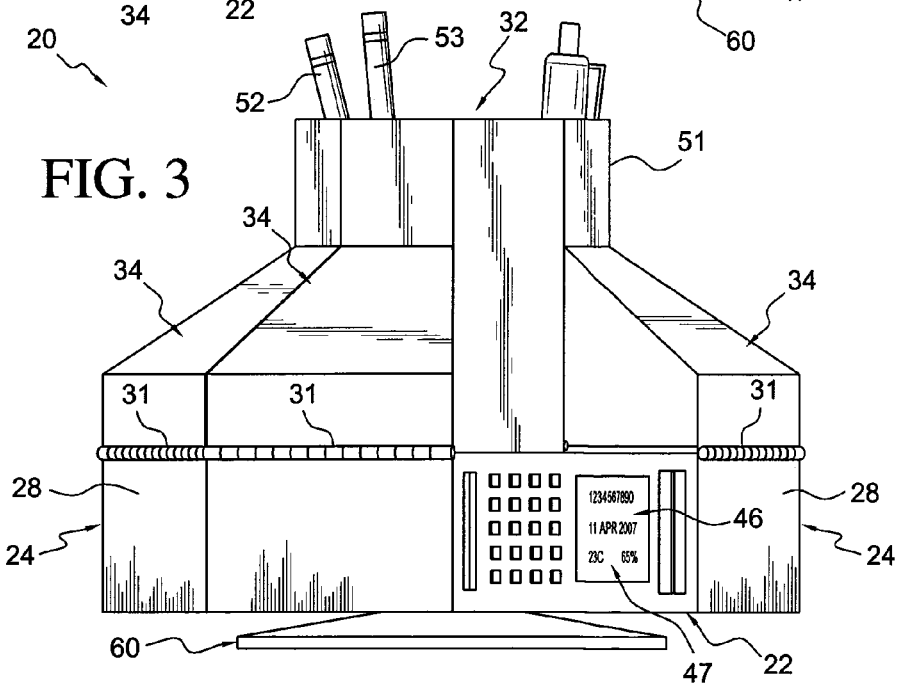
FIG. 3 is a front view of a front elevational view of a multi-chamber container as shown in FIG. 2 but with all of the chambers in a fully closed position.

FIG. 3 shows another embodiment of the invention that is similar to the embodiment shown in FIG. 2 but without a light. As shown, an upwardly extending wall 51 has an octagonal shape as opposed to the circular wall 41 in FIG. 2. Further, the embodiment of FIG. 3 is shown with all of the upper chambers 34 folded over onto the lower chambers 24. Two pencils 52 and 53 are shown extending above the wall 51.

Figure 4:
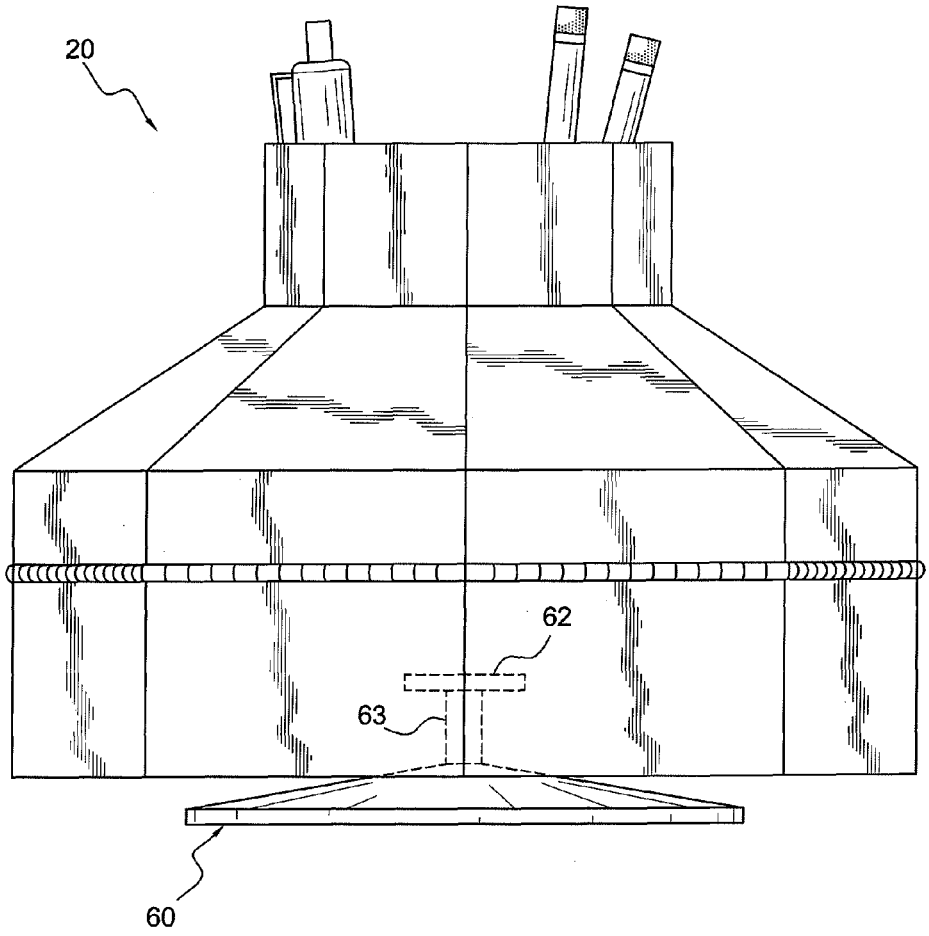
FIG. 4 is a schematic illustration illustrating the rotatable nature of the container shown in FIG. 1.

FIG. 4 is a schematic illustration showing a support 60 for rotatably supporting the multi-chamber container on a flat surface (not shown). The support 60 includes an upper mounting plate 62 and vertical shaft 63 for supporting the multi-chamber container 20 for rotation about the shaft 63. Suitable bearings and apparatus for rotational movement are not shown, since other conventional assemblies may be used which are well understood by persons of ordinary skill in the art.

While the invention has been disclosed in connection with its preferred embodiments it should be recognized that changes and modifications may be made therein without departing from the scope of the claims.

What is claimed is:

1. A multi-chamber container for stationery supplies, comprising:

a polygon shaped base member having a central axis and a support member for supporting said polygon shaped base member on a flat surface and wherein said base member is rotatably mounted about said central axis on said support member, said base member including an outer wall, an inner wall and a plurality of radially extending in an outward direction from said central axis, divider walls extending between said inner wall and said outer wall to form a plurality of trapezoidal shaped adjacent lower chambers surrounding an inner chamber formed by said inner wall;

a plurality of adjacent trapezoidal shaped upper chambers surround said inner wall, each of said plurality of adjacent trapezoidal shaped upper chambers includes a bottom, an upper inner wall of a selected height, an upper outer wall of a selected height shorter than said selected height of said upper inner wall, and two radially extending upper walls extending outwardly with respect to said central axis and connecting said upper inner and said upper outer walls, and wherein each of said plurality of adjacent trapezoidal shaped upper chambers is hingedly connected to said outer wall of a respective one of said lower chambers along said upper outer wall to enable each upper chamber open outwardly away from said respective lower chamber; and a plurality of trapezoidal shaped lids having a size and shape corresponding to the size and shape of said upper and lower chambers and wherein one of said lids form a closure for one of said upper chambers and one of said lower chambers, wherein said upper inner wall abuts against said inner wall when said plurality of adjacent trapezoidal shaped upper chambers surround said inner wall in a closed or superimposed position, and wherein said upper outer wall abuts against said outer wall of said base member when said plurality of adjacent trapezoidal shaped upper chambers are in an open position.

2. A multi-chamber container for stationery supplies according to claim 1 in which each of said trapezoidal lids is hingely connected to said upper chamber and adapted to open outwardly away from said inner chamber.

3. A multi-chamber container for stationary supplies according to claim 2 wherein said trapezoidal shaped upper chambers and said trapezoidal shaped lids each have two parallel sides including a larger parallel side and a shorter parallel side and wherein each lid is hingely connected along said shorter parallel side of said lid to a shorter parallel side of said upper chamber and is adapted to fold inwardly between said upper chamber and said lower chamber.

4. A multi-chamber container for stationery supplies according to claim 3 in which inner chamber defines an open top and is adapted to receive pencils and pens therein.

5. A multi-chamber container for stationery supplies according to claim 4 in which multi-chamber container is octagonal and includes eight trapezoidal shaped lower chambers, seven trapezoidal shaped upper chambers and seven trapezoidal shaped lids.

6. A multi-chamber container for stationery supplies according to claim 4 in which said container houses a radio.

7. A multi-chamber container for stationery supplies according to claim 5 in which said multi-chamber container includes a light disposed above said inner chamber.

8. A multi-chamber container for stationery supplies according to claim 7 in which said polygon shaped base member, said plurality of trapezoidal shaped lower chambers, said plurality of trapezoidal shaped upper chambers and said trapezoidal shaped lids are made of a transparent plastic.

9. A multi-chamber container for stationery supplies according to claim 8 in which said multi-chamber container is portable and includes a handle on one side thereof.

10. A multi-chamber container for stationery supplies according to claim 9 in which said multi-chamber container includes a clock and temperature indicator.

11. A multi-chamber container for stationery supplies according to claim 4 which includes between five and eight adjacent lower chambers, between five and eight adjacent upper chambers, between five and eight trapezoidal lids and an overall shape of a pentagon, hexagon, heptagon or a octagon.

12. A multi-chamber container for stationery supplies according to claim 3 wherein each of said plurality of upper and lower chambers are substantially aligned on top of one another when in a closed position.

* * * * *